United States Patent [19]

Finkbeiner

[11] Patent Number: 4,474,329

[45] Date of Patent: Oct. 2, 1984

[54] APPARATUS FOR FORMING A PLURALITY OF VENTED JETS PARTICULARLY A SHOWER HEAD

[75] Inventor: Werner Finkbeiner, Schiltach, Fed. Rep. of Germany

[73] Assignee: Hans Grohe GmbH & Co. KG, Fed. Rep. of Germany

[21] Appl. No.: 357,212

[22] Filed: Mar. 11, 1982

[30] Foreign Application Priority Data

Mar. 16, 1981 [DE] Fed. Rep. of Germany ..... 3110029

[51] Int. Cl.[3] ..... B05B 7/00

[52] U.S. Cl. ..... 239/428.5; 239/432

[58] Field of Search ..... 239/428.5, DIG. 18, 239/432, 553.5, 590.5, 446, 447, 449

[56] References Cited

U.S. PATENT DOCUMENTS

| | | | |
|---|---|---|---|
| 2,510,396 | 6/1950 | Goodrie | 239/428.5 |
| 2,565,554 | 8/1951 | Goodrie | 239/428.5 |
| 2,670,942 | 3/1954 | Aghnides | 239/438.5 X |
| 3,182,916 | 5/1965 | Schulz | 239/432 X |
| 3,799,450 | 3/1974 | Braukman | 239/428.5 |
| 4,082,225 | 4/1978 | Haynes | 239/428.5 |
| 4,379,097 | 4/1983 | Leggett | 239/428.5 X |

FOREIGN PATENT DOCUMENTS

| | | | |
|---|---|---|---|
| 1076582 | 2/1960 | Fed. Rep. of Germany | 239/428.5 |

*Primary Examiner*—John J. Love
*Assistant Examiner*—Mary McCarthy
*Attorney, Agent, or Firm*—Steele, Gould & Fried

[57] ABSTRACT

The invention relates to an apparatus, particularly a shower head for forming a plurality of vented jets. The apparatus has a device for producing individual jets. It also has at least one underlying air space and obstacles projecting laterally into the paths of the individual jets, which deflect the latter and, while mixing with air atomize the said jets. Passage channels, which can have vortexing portions and quieting portions are provided for each vented jet for further influencing the air/water mixture. Several individual jets are used for producing a single vented jet. The object of the invention is mainly intended for use in the sanitary field.

30 Claims, 11 Drawing Figures

FIG.7
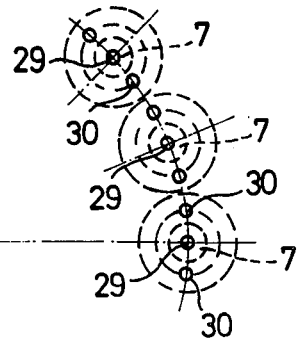
FIG.3
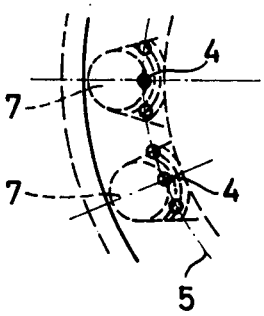
FIG.5
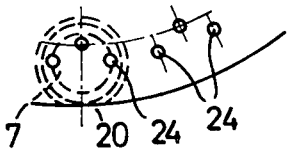
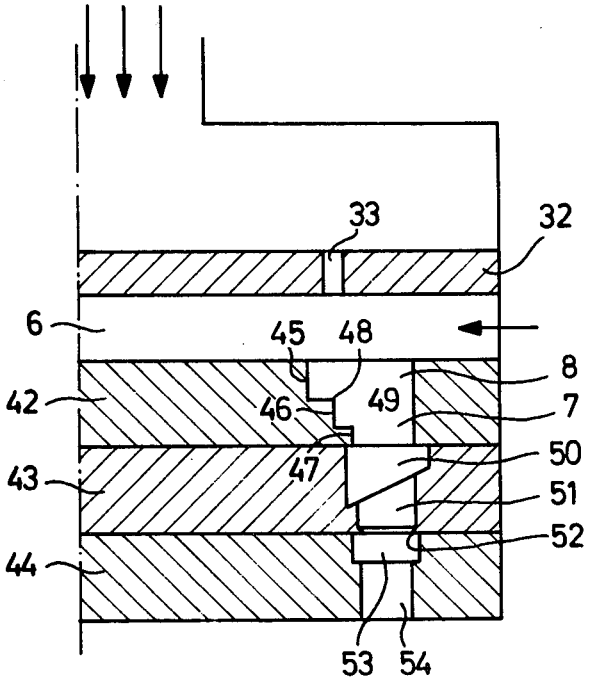
FIG.11

APPARATUS FOR FORMING A PLURALITY OF VENTED JETS PARTICULARLY A SHOWER HEAD

BACKGROUND OF THE INVENTION

The invention relates to an apparatus for forming a plurality of vented jets, particularly a shower head, with a device for producing unvented individual jets, at least one air access space positioned below it and a plurality of passage channels with obstacles projecting into the path of the individual jets for atomizing the latter.

Known devices for producing vented water jets generally have a perforated plate, beneath which is disposed in spaced manner a wire screen or sieve, which brings about the separation and mixing of the individual jets passing through the perforated plate with the air. The mesh width of the sieve is such that the sieve openings are smaller than the perforations of the perforated plate, so that dirt particles carried out of the pipe or mains are left behind in the sieve and disturb the jet pattern or reduce the passage of water. Scaling has the same effect and in the case of fine-meshed sieves progresses very rapidly and with calcareous water rapidly leads to such a flow reduction that it is no longer possible to suck in an adequate quantity of air.

Offenlegungsschrift No. 28 21 195 discloses a hand-held shower with devices for forming vented jets. In this device the obstacle for atomizing an individual jet in a passage channel is constituted by a disk-like jet splitting or dividing element with a concave surface, whose diameter is a multiple of the diameter of the outlet for the individual jet, It is placed axially in the path of the individual jet, so that the latter strikes directly against the disk and is reflected by the latter. This greatly decelerates the individual jet, so that there are serious energy losses and consequently the jet pattern is unfavourably influenced.

BRIEF SUMMARY OF THE INVENTION

The object of the present invention is to provide an apparatus for forming vented water jets, which does not require a sieve, but in which the water jets are decelerated to the minimum.

According to the invention this object is achieved in that at least two individual jets are directed on to each channel and the obstacles for atomizing the individual jets project laterally of the channel wall into the path of in each case at least one individual jet. As a result during atomization the individual jet is merely deflected and not reflected, so that it at least partly retains its original direction of movement, but is still atomized to such an extent that there is a satisfactory absorption of air and mixing therewith. The channel portion which atomizes the original jets preferably has nonuniform and in particular abrupt cross-sectional reductions, which can have a step-like form.

Further developments of the invention can be gathered from the subclaims and the description of embodiments in conjunction with the drawings.

It is additionally pointed out here that the impact surface of the obstacles is preferably inclined perpendicular to the flow direction or into the flow direction. If it is perpendicular to the flow direction, the obstacle preferably only projects sufficiently far into the path of an individual jet that the latter is only partly affected. As several individual jets are used for producing a single vented jet, there is at the same time a reciprocal influencing of the deflected individual jets, so that mixing of the sucked-in air is improved. The invention also advantageously provides jet guidance members, which exert a further influence on the vented jets. To this end following on to the portion used for atomizing the jets, there is advantageously at least one jet vortexing portion, which preferably has at least one cross-sectional enlargement, which can be abrupt and e.g. can be in the form of an undercut provided on the channel wall. A shaping portion having at least one cylindrical portion is advantageously provided for the lateral definition and quieting of the vented jet. The jet shaping portion preferably has step-like and/or conical cross-sectional reductions, which are advantageously positioned in front of the cylindrical portion (considered in the flow direction). Preferably the holes or perforations in the apparatus for producing the individual jets are arranged eccentrically with respect to the axis or axes of the jet guidance members and are deflected towards the longitudinal axes of the jet guidance members by the also eccentrically positioned obstacles. Thus, frictional losses can be kept low. It is also advantageous if the passage cross-section through the jet guidance members is not adjusted by the obstacles, which are generally positioned at the edge of the openings, as is the case in the known shower apparatus. In fact the internal cross-section of the jet guidance members, particularly the diameter of the linear free passage through the complete channel is always a multiple larger than the diameter of the jet-forming holes, which reduces risks of blockage or clogging. According to preferred developments of the invention, the further influencing of the vented jet always takes place from the outer edge, particularly with the aid of differently shaped cross-sectional enlargements and/or constrictions. As a result it is possible to produce the apparatus according to the invention in a simple manner, e.g. in the form of individual disks or rings made from thermoplastic materials, in which the jet guides are formed by injection moulding with simple moulds.

The holes for forming the individual jets generally have a diameter of approximately 0.5 to 2.5 mm and can have different cross-sectional shapes. It can also be advantageous in per se known manner to provide a disturbing or interfering member for the individual jets in order to disturb the jet or impart an angular momentum thereto, said member being provided e.g. in the bore or at the water inlet point to the corresponding bore or opening. The height of the air space between the nozzles or holes forming the individual jets and the obstacles which atomize the latter can vary within wide limits and is generally 0.5 to 5 mm, preferably up to 3 mm, but can also be significantly greater. The outlet cross-section of the vented jet or the internal diameter of a jet forming means optionally provided for this purpose, can also vary within wide limits and is generally 2 to 15 mm, preferably about 4 to 6 mm. The inlet cross-section or diameter of the jet guidance members or a passage channel formed by the latter and intended for receiving the individual jets to be atomized, is generally larger and normally has an internal diameter of 4 to 20 mm, preferably 6 to 12 mm.

Step-like cross-sectional reductions or constrictions which can be used for forming the obstacles, but also step-like cross-sectional enlargements or undercuts preferably represent 5 to 25% and most advantageously 10 to 20% of the internal diameter of the adjacent guidance members or channel portions and naturally a plurality of enlargements and/or constrictions can follow one another. The same applies regarding the conically widened and/or narrowed portions, in which the angle of inclination to the longitudinal axis of the individual jets is generally approximately 30° to 60° and preferably approximately 45°.

Generally there are at least 5 and preferably 10 to 50 individual devices for producing a vented jet in a shower head or some other shower member. The individual jets emerge at an angle to one another and in particular diverge. The depth of the obstacles projecting laterally into the passage channel or projecting behind a preceding obstacle or wall part, is normally ¼ to three times and preferably ½ to one times the internal diameter of the jet-forming hole or perforation. The steps are preferably interconnected, so that they represent closed staircases, the "stairs" being interconnectable from the leading edge to the trailing edge or from the trailing edge to the trailing edge. It is also possible to construct the constrictions and/or enlargements in such a way that a curved longitudinal section is obtained. It is also possible for curved portions to alternate with angular and/or conical portions.

BRIEF DESCRIPTION OF THE DRAWINGS

The invention is described in greater detail hereinafter relative to non-limitative embodiments and with reference to the attached drawings, wherein show:

FIG. 3 a section along the line A—A of FIG. 1.

FIG. 5 a section along the line C—C of FIG. 4.

FIG. 7 a section along the line D—D in FIG. 8.

FIG. 11 a section through a further embodiment.

DETAILED DESCRIPTION OF THE PREFERRED EMBODIMENTS

Figure 1:
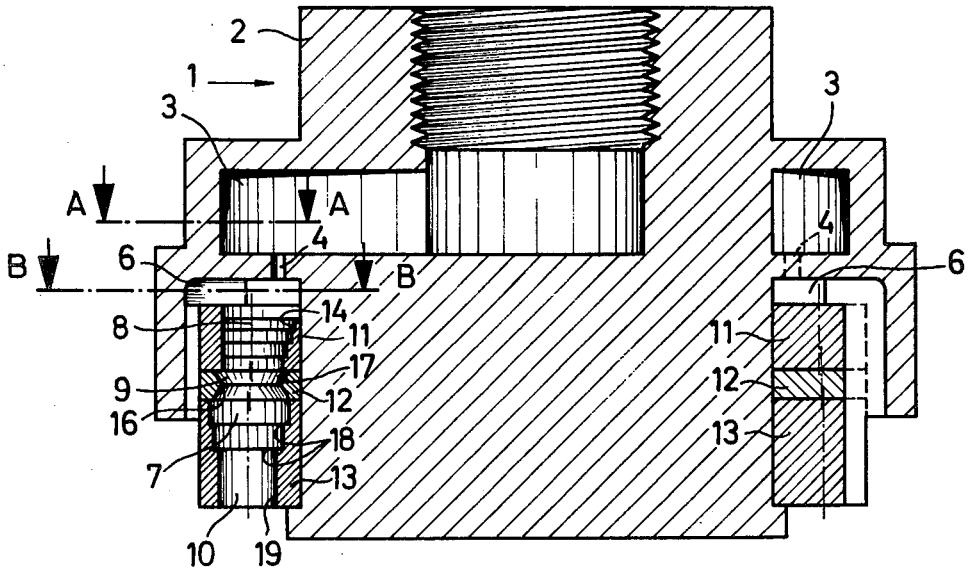
FIG. 1 a cross-section through one embodiment of the invention.
Figure 2:
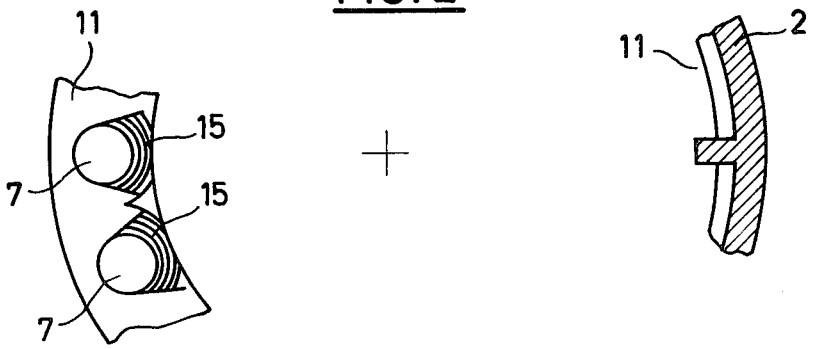
FIG. 2 a section along the line B—B of FIG. 1.

In the case of the embodiment shown in FIGS. 1 to 3, unlike other shower or massage devices, a shower head 1 has a device for producing vented jets. For this purpose shower member 2, which is provided with a reversible water intake 3, is provided with a plurality of parallel water jet-forming holes 4 arranged on a circular arc-shaped ring 5. At the outflow end of the holes 4 is provided an air space 6 connected to a venting slot and below which there is in each case a passage channel 7 for a vented water jet, channel 7 being arranged eccentrically to holes 4, i.e. with a greater radial spacing and the same is positioned from the central axis of shower head 1 (cf. FIG. 3). In each case three holes 4 are associated with one passage channel 7. Each passage channel 7 has a jet atomizing portion 8, a vortexing portion 9 and a quieting portion 10, which are in each case formed by correspondingly shaped openings in superimposed rings 11, 12 and 13. The jet producing portion 8 has an eccentric step system in the form of an amphitheatre-like staircase with four curved steps 14. The step system 15 is positioned below the associated holes 4 of ring 5 and forms an obstacle for the full individual jets passing out of holes 4, thereby atomizing and laterally deflecting the said jets. As a result the entire cross-section of the passage channel 7 is filled and the sucked-in air is entrained in bubble form.

The vortexing portion 9 formed by the openings in ring 12 has a conical taper 16 with a following and substantially equally large conically widened portion. It is important for the inlet cross-section of the opening of the vortexing portion 9 to be larger than the outlet cross-section of the jet atomizing portion 8, so that an undercut 17 is formed at the transition between the two portions. This undercut ensures good turbulence and mixing between the air and water, still fed through the taper or constriction in the vortexing portion. The inlet cross-section of the following quieting portion 10 essentially corresponds to the outlet cross-section of vortexing portion 9, i.e. following the constriction of the vortexing portion, the flow rate of the vented jet is slowed down somewhat by the cross-sectional enlargement, so that quieting occurs here. The portion of passage channel 7 forming the quieting portion and which, like the vortexing portion, has an essentially rotationally symmetrical configuration and has two step-like cross-sectional constrictions 18, on to which follows a longer cylindrical portion 19. Thus, in the quieting portion the vented jet is initially sped up somewhat by the constrictions 18 and is then shaped in the cylindrical portion 19, so that it emerges as a vented jet with a substantially constant cross-section and which is able to hold the mixed-in air over a long distance. The spacing of the outlets of passage channels 7 is kept adequately large to ensure that the vented water jets do not make contact with one another.

Figure 4:
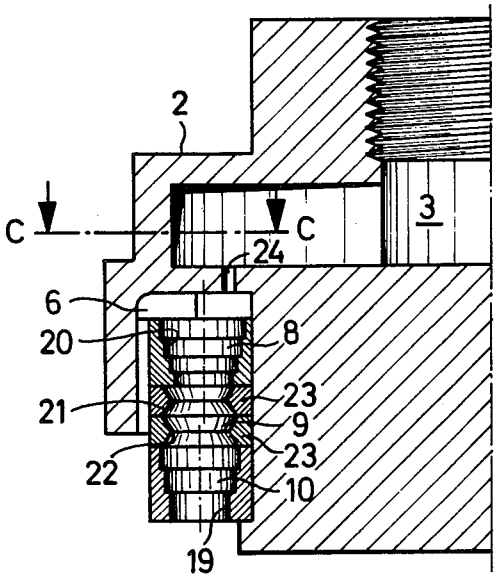
FIG. 4 a partial section through another embodiment.

In the case of the embodiment shown in FIGS. 4 and 5 in which, as in the following embodiments, corresponding parts are given the same reference numerals, all three portions of the passage channel 7, namely the jet atomizing portion 8, vortexing portion 9 and quieting portion 10 are provided with rotationally symmetrical passage openings. The steps 20 of the jet atomizing portion are consequently constructed as complete circles, as opposed to the steps 14 of the step system 15 of the embodiment according to FIGS. 1 to 3, which are only in the form of a circular arc portion. A further difference of the embodiment of FIG. 4 is that the vortexing portion 9 represents a doubling up of the vortexing portion of FIG. 1 and has two conical constrictions 21 and 22 with the following conically widened portions. For this purpose there are preferably two superimposed disk-shaped rings 23 which, if desired, can have in the vicinity of their constrictions 21, 22 radial venting bores for the additional venting of the vented jet. Portion 10 of passage channel 7 constituting the quieting portion also has a step system, but the following cylindrical portion 19 is somewhat shorter than in the case of the embodiment of FIG. 1.

As can be gathered from FIG. 5 with each passage channel 7 are once again associated three water jet-forming holes 24 which, as in FIG. 1, are aligned in such a way that the jets emerging from them strike the individual steps or stairs 20 in different ways. For this purpose in each case groups of three holes 24 are provided, each group of holes being located on a circular arc, approximately corresponding to the circular arc of the second or third step 20 of the jet atomizing portion 8, whose centre is however somewhat outwardly displaced compared with the rotation axis of the portion 8. In addition, portions 8, 9 and 10 of passage channel 7 are somewhat axially displaced with respect to one another.

Figure 6:
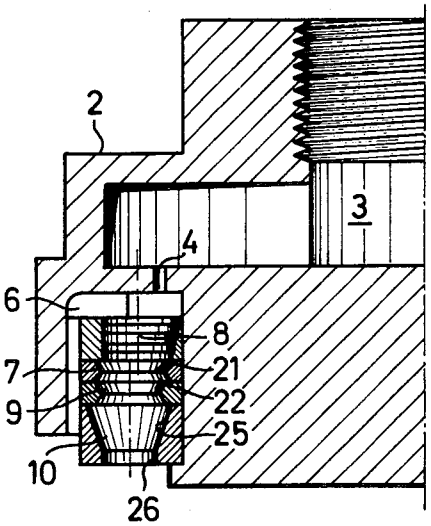
FIG. 6 a part section through a further embodiment.

In the embodiment of FIG. 6 the jet atomizing portion 8 of passage channel 7 essentially corresponds to that of the embodiment of FIG. 1. The vortexing portion 9, as in the embodiment of FIG. 4, has two conical constrictions 21 and 22 and is once again formed by two disk-shaped rings 23. Portion 10 forming the quieting portion has, however, a conical constriction 25 with which is linked a short cylindrical portion 26, in place of the step system. The inlet cross-section of cone 25 is larger than the outlet cross-section of vortexing portion 9, so that there is once again an undercut between the two portions and this undercut increases turbulence before the vented jet in cone 25 and the following cylindrical portion 26 is subject to a quieting influence.

Figure 8:
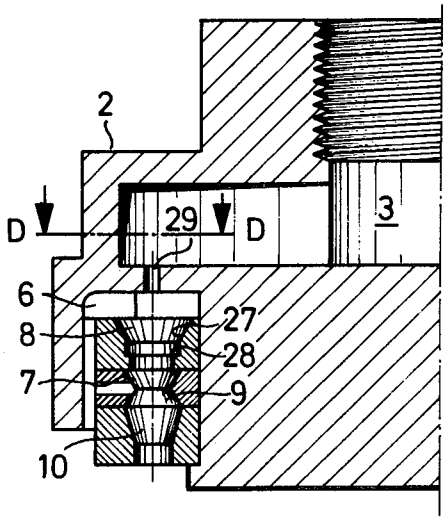
FIG. 8 a part section through a further embodiment.

In the embodiment of FIGS. 7 and 8, the jet atomizing portion 10 of passage channel 7 has a conical taper 27 and two following cylindrical portions with an intermediate step system 28. As a result of such variations compared with the previously described embodiments it is possible to influence the atomizing characteristics in the atomizing portion. The shape of the vortexing portion 9 is essentially the same as that of FIG. 1 and vortexing portion 10 is the same as that of FIG. 6, but in this case there is no undercut between portions 9 and 10. The outlet cross-section of portion 9 and inlet cross-section of portion 10 are of the same size and have the same shape. In addition, the rotation axes of the three portions 8, 9 and 10 in this embodiment coincide. As can be gathered from FIG. 7, three water jet-forming holes are associated with each passage channel 7. In this embodiment the holes are positioned on a circular arc intersecting the axes of the passage channel 7. In each case the central hole 29 issues into channel 7 along the longitudinal axis thereof, so that the water jet formed could pass unimpeded through channel 7 if it were not disturbed and consequently atomized by the two other water jets emerging from the outer holes 30 and which strike cone 27 or steps 28. A further special characteristic of this embodiment is that instead of combining holes 29 or 30 into groups of threes, they are equidistantly arranged along a circular arc. The inlets of passage channels 7 are so close together that they are essentially in contact with one another and are substantially free from a separating web. In this embodiment it has been found that a precise alignment of the holes 29 or 30 with the axes of passage channels 7 is unnecessary. In fact an imprecise, i.e. asymmetrical alignment can lead to an improvement of the pattern of the vented jets.

Figure 9:
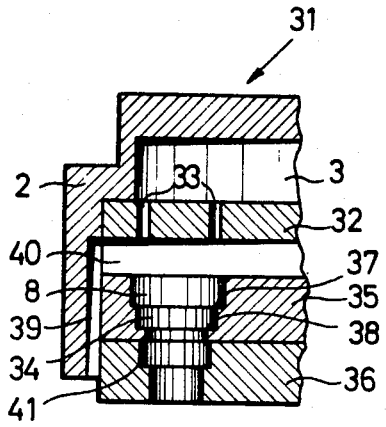
FIG. 9 a part section through a further embodiment.
Figure 10:
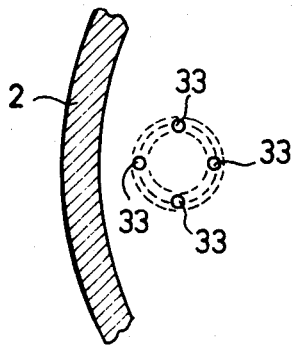
FIG. 10 a section along the line E—E in FIG. 9.

FIGS. 9 and 10 show a particularly preferred embodiment of the invention, which is very simply constructed, but still has a very good jet pattern. A shower head 31 has a plurality of holes 33, combined into groups of four in a perforated plate 32. The four holes 33 are in each case positioned on a circular arc, which is symmetrical to a passage channel 34 and whose diameter is slightly smaller than the inlet diameter of inlet channel 34. Two disk-shaped rings 35 and 36, provided with corresponding openings are used for forming passage channel 34. The opening in ring 35 forming the jet atomizing portion 8 has three diameter stages, whose diameters and heights decrease from top to bottom. Thus, the diameters are e.g. 8, 7 and 5.5 mm and the heights 2.5, 1.5 and 1 mm. The holes 33 in perforated plate 32 are oriented in such a way that the individual jets emerging from them strike the edge of shoulder 37 between the upper and central diameter stages and are broken up by the latter. Further breaking up takes place at shoulder 38 between the central and lower diameter stages. As a result of this deflection and breaking up of the water jets, once again the entire cross-section of the passage channel is filled and air sucked through a venting slot 39 into an air space 40 located beneath the perforated plate is entrained. In this embodiment there is no longitudinal portion formed by a separate part for forming a vortexing portion. Thus, the outlet cross-section with the opening in the disk-shaped ring 35 is smaller than the inlet cross-section of the following ring 36, so that an undercut 41 with a sudden cross-sectional enlargement is formed at the transition. The opening in the disk-shaped ring 36 has two diameter stages, namely an upper stage with a diameter of 6 mm and a lower stage with a diameter of 4.5 mm, the height of the upper stage being about 2.5 mm, i.e. somewhat less than that of the lower stage, which is about 3 mm. This embodiment has a reduced overall height. Thus, it can be combined without difficulty with the other devices of a shower head, e.g. a massage device or a conventional shower unit, without this leading to large and cumbersome constructions. The perforated plate 32 and the disk-shaped rings 35 and 36 with their openings can also be simply produced by injection moulding and by the shaping or hollowing out of corresponding stop members can be easily aligned with respect to one another, so that the individual plates or disks and their openings can be easily positioned in the same axis. The holes 33 in perforated plate 32 generally have a diameter of 1 mm. It is also possible to have 5 holes.

In the also preferred embodiment of FIG. 11, a shower head has a perforated plate 32 with holes 33 which, as in the embodiment of FIGS. 1 to 3 are arranged on a circular arc. Below perforated plate 32 there is an air space 6 with channels for the entry of air, which are not shown in the drawing. The air space is followed by passage channels 7 which, as in the embodiment of FIGS. 1 to 3 are eccentric, i.e. are arranged in outwardly displaced manner beneath holes 33. Once again three holes are associated with each passage channel. The holes have a diameter of about 1.2 mm. The passage channels in this embodiment are once again formed by openings in three superimposed disks or rings 42, 43 and 44. The opening in upper ring 42 forming the jet atomizing portion essentially has the shape described in connection with the embodiment of FIGS. 1 to 3, but the stairway formed by the arc portions has only three diameter steps 45, 46, 47 with two intermediate step edges 48, 49.

Following diameter step 47 with the smallest diameter there is a disk or ring 43, whose opening is not limited to a single passage channel 7. Instead it initially has an annular slot 50 forming a transverse connection of all the passage channels 7. The width of annular slot 50 is greater than the diameter of diameter step 47, so that the undercut form aids the vortexing of the vented water jet. Annular slot 50 has a bevelled bottom with which is linked, corresponding to each passage channel, a substantially cylindrical bore 51, whose diameter is smaller than that of the smallest diameter stage 47 of the jet atomizing portion 8. At its end facing the lower ring 44, cylindrical bore 51 has a slight constriction 52 with a sharp inner edge which, together with the inlet cross-section of the underlying disk 44, once again forms an undercut. At its inlet side disk 44 has an all-round annular slot 53, which interconnects all the quieting portions of passage channels 7. Slot 53 is once again followed by a cylindrical portion 54, whose diameter essentially corresponds to the cylindrical portion 51 in ring 43 or is slightly smaller than the latter.

What is claimed is:

1. An apparatus for forming a vented jet, comprising:

a device for producing unvented individual jets, said unvented jets being directed along a flowpath in a flow direction, at least one air access space being located downstream of said device; and, a passage channel defining a linearly open passageway along the flowpath, the channel having walls defining obstacles projecting into the flowpath for atomizing the individual jets, at least two of the individual jets being directed into said passage channel and the obstacles for atomizing the individual jets projecting laterally of the channel wall into a path of at least one of the individual jets.

2. An apparatus according to claim 1, wherein the passage channel is unobstructed along an axial central passage opening having an internal diameter larger than a cross-section of an unvented individual jet and the flow direction of said individual jet being displaced with respect to the axis of the passage opening in the channel.

3. An apparatus according to claims 1 or 2, wherein the obstacles, along the flow direction, project into the passage channel as lateral projections forming constrictions in the passage channel.

4. An apparatus according to claim 3, wherein the obstacles comprise edges on the walls of the channel, the edges being arranged in substantially perpendicular manner to the flow direction.

5. An apparatus according to claim 1, wherein the passage channel is wider at an inlet adjacent the air access space than at an outlet for the vented jet.

6. An apparatus according to claim 1, wherein the channel has an asymmetrical cross-section.

7. An apparatus according to claim 6, wherein the cross-section of the channel is eccentrically reduced in the flow direction.

8. An apparatus according to claim 6, wherein the obstacles project only from one side of the wall of the channel into the path of the individual jets.

9. An apparatus according to claim 1, wherein, in the flow direction of an individual jet, a plurality of successively arranged obstacles are provided for atomizing the jets.

10. An apparatus according to claim 9, wherein the obstacles have different shapes.

11. An apparatus according to claims 9 or 10, wherein the obstacles constitute a step-like separating means for the individual jets.

12. An apparatus according to claim 1, wherein the channel is cross-sectionally rectangular.

13. An apparatus according to claim 12, wherein the cross-sectional shape of the channel varies in the flow direction and is round at the outlet.

14. An apparatus according to claim 1, wherein three to ten devices for producing individual jets are associated with the channel.

15. An apparatus according to claim 1, wherein a plurality of individual jets are associated with the channel and a direct path of at least one of the plurality of individual jets is free of the obstacles.

16. An apparatus according to claim 1, wherein in the flow direction, the channel has a plurality of portions, including a jet atomizing portion having the obstacles and at least one jet vortexing portion having cross-sectional variations.

17. An apparatus according to claim 16, comprising a plurality of channels, and wherein each channel has at least one jet shaping portion.

18. An apparatus according to claim 16, wherein the cross-sectional variations of the jet vortexing portion have a conical configuration.

19. An apparatus according to claims 16 or 18, further comprising at least one air intake issuing into the jet vortexing portion.

20. An apparatus according to claim 19, wherein the air intake issues at a point of the jet vortexing portion having a constriction.

21. An apparatus according to claim 1, comprising a plurality of passage channels, and wherein the passage channels are interconnected by transverse channels.

22. An apparatus according to claim 1, comprising a plurality of passage channels, and wherein the passage channels are formed by openings in a plurality of axially superimposed bodies, the bodies being disks.

23. An apparatus according to claim 22, wherein the axes of the openings are displaced with respect to one another.

24. An apparatus according to claim 1, wherein the channel is cross-sectionally curved.

25. An apparatus according to claim 1, wherein the channel is cross-sectionally round.

26. An apparatus according to claim 16, wherein the variations are constrictions.

27. An apparatus according to claim 16, wherein the variations are enlargements.

28. An apparatus according to claim 16, wherein the variations include both constrictions and enlargements.

29. An apparatus according to claim 16, wherein the variations have a step-like configuration.

30. An apparatus according to claim 22, wherein the disks are centrally open, thereby forming rings.

* * * * *